US008243979B2

(12) United States Patent
Yu

(10) Patent No.: US 8,243,979 B2
(45) Date of Patent: Aug. 14, 2012

(54) FULL-GAMUT SINGLE-BODY SOUND MEMBRANE THAT CONFORMS TO A PHYSICAL PROPERTY OF SOUNDING

(75) Inventor: Sheng-Hsiung Yu, Taoyuan (TW)

(73) Assignee: Yon Shing Industrial Co., Ltd., Taoyuan (TW)

( * ) Notice: Subject to any disclaimer, the term of this patent is extended or adjusted under 35 U.S.C. 154(b) by 1324 days.

(21) Appl. No.: 11/700,243

(22) Filed: Jan. 31, 2007

(65) Prior Publication Data

US 2008/0181445 A1 Jul. 31, 2008

(51) Int. Cl.
*H04R 25/00* (2006.01)

(52) U.S. Cl. ..... 381/426; 381/396; 381/423

(58) Field of Classification Search ..... 381/396, 381/400, 423–424, 426–428, 432
See application file for complete search history.

(56) References Cited

U.S. PATENT DOCUMENTS

| | | | | |
|---|---|---|---|---|
| 3,905,448 | A * | 9/1975 | Kawakami et al. | 181/172 |
| 4,132,872 | A * | 1/1979 | Inoue | 381/424 |
| 4,275,278 | A * | 6/1981 | Sakurai et al. | 381/426 |
| 6,282,298 | B1 * | 8/2001 | Azima et al. | 381/423 |
| 6,694,038 | B1 * | 2/2004 | Azima | 381/423 |
| 6,757,404 | B2 * | 6/2004 | Takewa et al. | 381/430 |
| 6,845,169 | B2 * | 1/2005 | Ishigaki | 381/426 |
| 6,862,361 | B2 * | 3/2005 | James et al. | 381/423 |
| 7,483,545 | B2 * | 1/2009 | Nagaoka | 381/423 |

* cited by examiner

*Primary Examiner* — Suhan Ni
(74) *Attorney, Agent, or Firm* — Rabin & Berdo, P.C.

(57) ABSTRACT

A sound device includes a full-gamut single-body sound membrane, a voice coil, a dust cover, and an assembly structure. Materials of different kinds of beating degrees are applied at different positions of the sound membrane. A structural intensity of materials is changed radiantly, radially and gradually, from an innermost rim of the sound membrane toward an outermost rim of the sound membrane, such that the structural intensity gradually decreases from the innermost rim toward the outermost rim, to satisfy requirements of sounding for the full-gamut of audible frequency.

10 Claims, 9 Drawing Sheets

FULL-GAMUT SINGLE-BODY SOUND MEMBRANE THAT CONFORMS TO A PHYSICAL PROPERTY OF SOUNDING

BACKGROUND OF THE INVENTION (a) Field of the Invention

The present invention relates to a sound device having the full-gamut single-body sound membrane, and more particularly to a single-body sound membrane structure in a speaker, wherein the sound membrane comprises multi-parts and each multi-part in the sound membrane structure is applied with material of different intensity, such that a full-gamut sounding requirement comprising high-frequency, mid-frequency, and low-frequency of audible range can be performed by a single-body sound membrane.

(b) Description of the Prior Art

As highly development of human economy, life quality is improved; along with that requirement of quality of leisure life is getting stringent. In all kinds of leisure activities, improvement of requirement in audio-visual activities, including watching TV programs, movies, or listening to music, relies on development of the audio-visual products. For the visual product, the development is changing with each passing day, and the product has been developed to a digital planar display with high resolution. No matter a liquid crystal display or a plasma TV set, the high resolution and low radiation product has been rapidly developed. On the contrary, there are few vendors who devote to the development for improvement and break-through of the audio product. The primary reason is that the structure of a speaker, which is a mainstream of the audio product, is simple and has been used for a long time, and hence is commonly recognized to have no space for the improvement. Although most of the research and development of existing audio products are focused on amplifying circuits, this concept of concentrating on details but forgetting the main objective is not correct from a viewpoint of the present inventor.

The speaker structure includes a sound membrane, and for the existing sound membrane, including a paper sound membrane, a recent aluminum sound membrane, plastic sound membrane, or a sound membrane made by any other material, locations where high-frequency, mid-frequency and low-frequency vibrations occur all reside in a single sound membrane of a same material, density, and intensity, which is provided with the following shortcomings:

1. In terms of characteristics, a characteristic curve is provided with a narrow range, a non-flat shape, and a large distortion, as shown in FIG. 1. Under a same magnetic circuit design, a peak-to-valley difference of the distortion is normally 10~15 dB, and a bandwidth is narrower, which is about 20~25% Hz. If a sound frequency is designed to be 10 KHz, then only 8 KHz can be achieved in reality, and for a design value of 20 KHz, only 10~13 KHz can be achieved before the sound frequency starts to descend. Otherwise, a short-loop design should be implemented, a tweeter (H-CONE) should be employed, vibration mass should be decreased, structure and mass of a voice coil should be changed, a row width of a voice coil wire should be decreased, or a shape of the voice coil body should be modified, which will increase cost, and result in a false property that is not in compliance with an audio condition to create a false tone.
2. In terms of tone quality, in a same sound membrane, the uniform material cannot develop proper timbre of the high-pitched, mid-range, and low-pitched tones at a same time. A limitation of the conventional sound membrane made by the uniform material of the same structure design can be described by a principle of see-saw; if the low-pitched tone is emphasized, then the mid-range tone will be lost, which results in an obscure and non-clear sound, on the other hand, if the mid-range tone is emphasized, then the low-pitched tone will be lost relatively, which results in a sharp and unpleasant sound. Obviously, one takes one thing into consideration to the neglect of the other. Unfortunately, a break-though has not been available yet to this limitation by the vendors.
3. In terms of efficiency, as the material, structure, and density of the same sound membrane are consistent, the single-body sound membrane cannot radiantly manifest the timbre under all kind of amplitudes of the high-pitched, mid-range, and low-pitched tones; and it is easy to result in non-smooth manifestation of the timbre. Therefore, the efficiency of sound membrane cannot be developed, and it is unable to require the sound membrane to achieve the best performance of timbre.

In order to manifest the perfect timbre of high-pitched, mid-range, and low-pitched tones without distortion, existing audio equipment can be deployed with a crossover which should be in collaboration with a separate tweeter, mid-range speaker, and woofer. The crossover can separate the high-pitched, mid-range, and low-pitched tones in music and fix the property and timbre, and then the sound can be sent out through the tweeter, mid-range speaker, and woofer of corresponding property, to acquire the manifestation of proper tone-quality.

Although each timbre of the high-pitched, mid-range, and low-pitched tone can be manifested by using the crossover in association with the separate tweeter, mid-range speaker, and woofer, the sound generated is not real and nature, and cost is high, by using the electronic crossover to fix and change the sound. Nevertheless, the world-wide audio technique has been limited by these flaws for a long time.

SUMMARY OF THE INVENTION

The primary object of present invention is to provide a sound device having the full-gamut single-body sound membrane that conforms to a physical property of sounding, such that the single-body sound membrane can perform the perfect full-gamut timbre and quality of high-frequency, mid-frequency, and low-frequency of audible range.

It is believed that if under a premise of using a single speaker without a crossover that a tone-quality effect of perfect performance of each timbre of the high-frequency, mid-frequency, and low-frequency without distortion can be achieved; then the speaker and audio product will have surmountable revolution and development. In view of that the sound membrane plays an important role in making the speaker to sound, the sound membrane will be a major factor in determining the property and quality of sound. Accordingly, it is imperative to develop the high quality sound membrane, and the epochal development of the sound membrane will be available by the present invention.

Accordingly, in the sound membrane structure of present invention, each location is provided respectively with different material intensity, and in particular, the structural intensity and density of material are gradually descended from high to low, with a gradient, radial and radiant variation, from an inner edge toward an outer edge of the sound membrane structure. Accordingly, each different position and region in the same sound membrane can sufficiently satisfy the requirement of sounding, such that the single sound membrane can develop into the perfect timbre, quality, and property of the high-frequency, mid-frequency, and low-frequency of audible range.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 2:
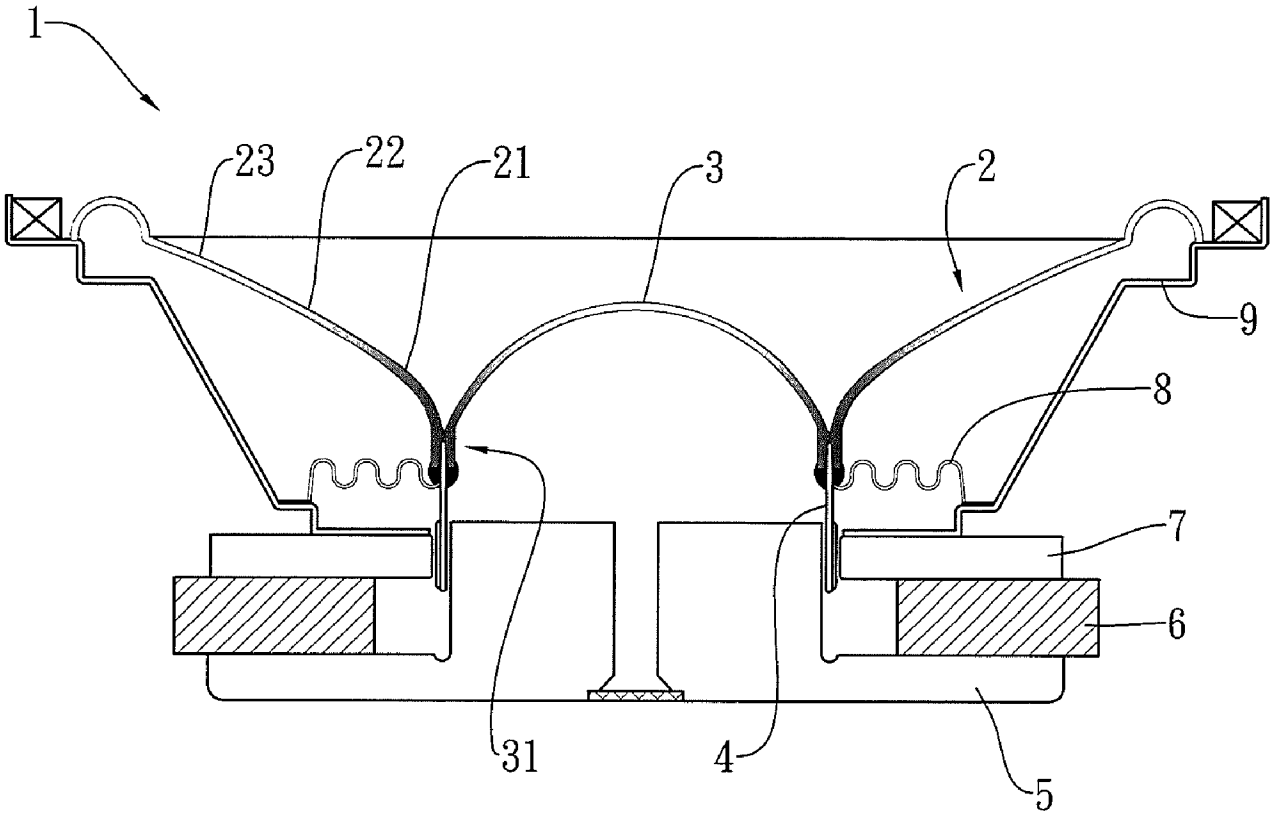
FIG. 2 shows a cross-sectional view of a speaker of the present invention.

Referring to FIG. 2, it shows a cross-sectional view of a speaker 1, which includes a sound membrane 2, a dust cover 3, a voice coil 4, an iron core 5, a magnet 6, a washer 7, a damper 8, and a frame 9.

Figure 3:
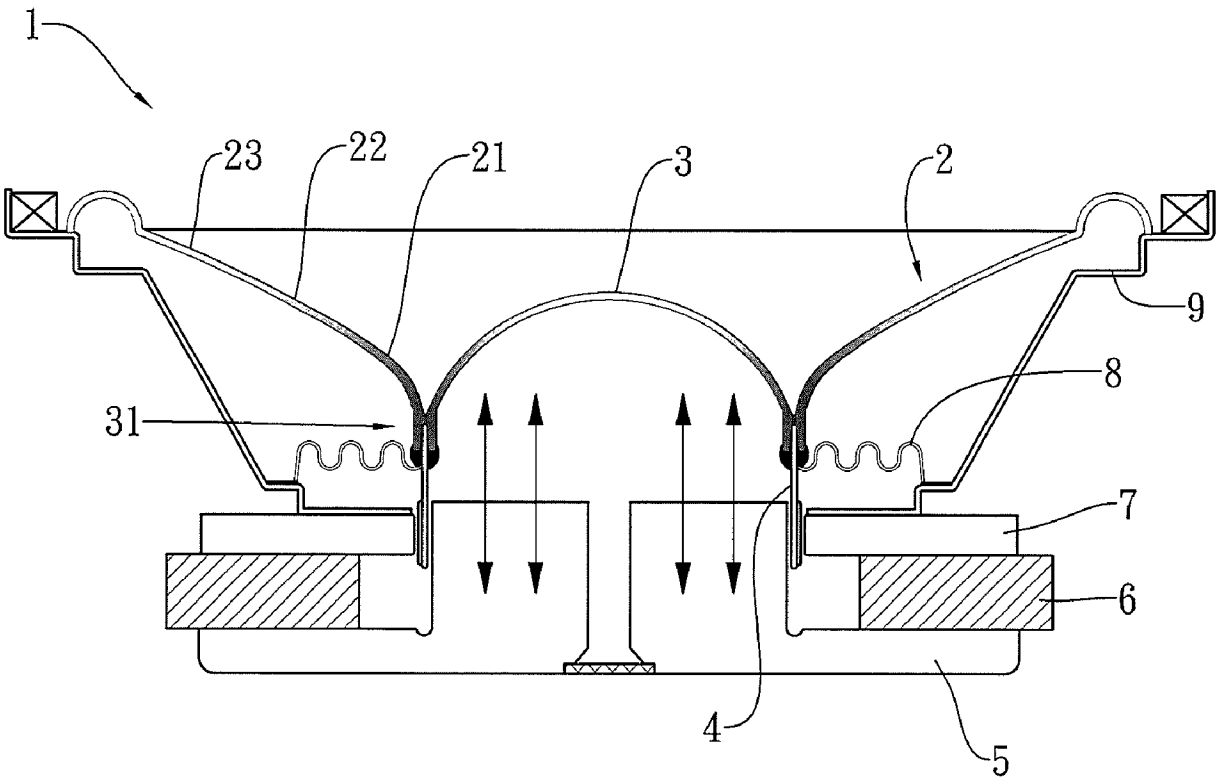
FIG. 3 shows a schematic view of a piston-style reciprocating movement of a speaker of the present invention.

In terms of audio equipment that fits with the speaker 1, electrical energy is converted into kinetic energy to cause the speaker 1 to carry out a piston-style reciprocating movement (as shown in FIG. 3), such that air can be pushed to create sound.

Figure 4:
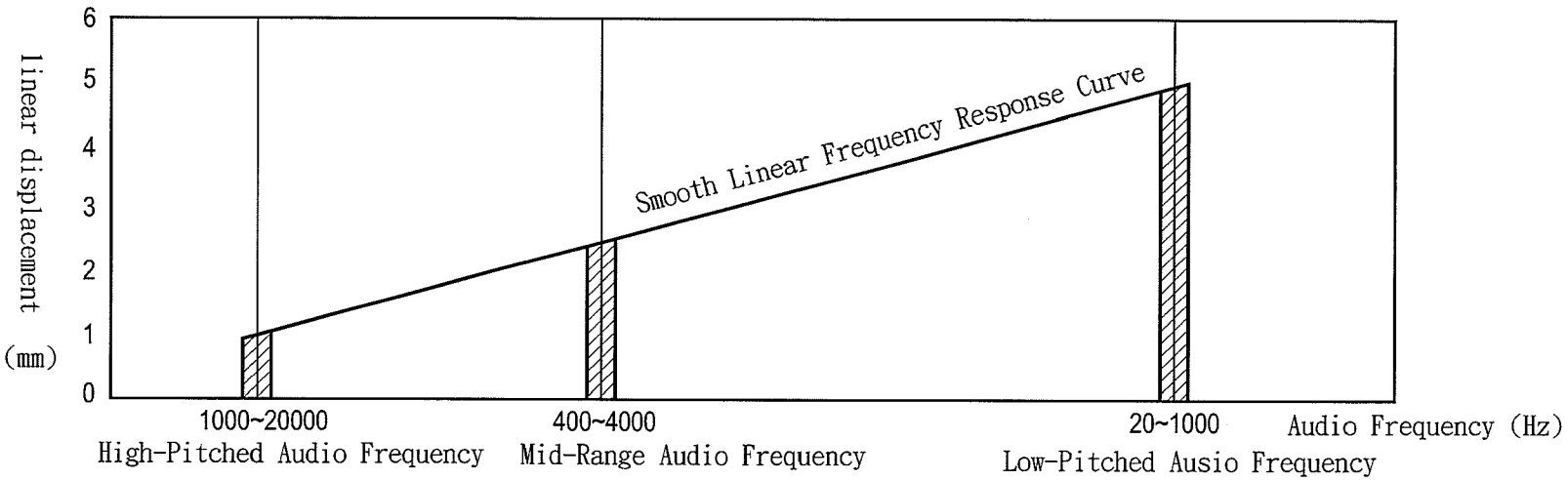
FIG. 4 shows a schematic gradient displacement response curve of a piston-style reciprocating movement of a sound frequency and a speaker of the present invention.

As shown in FIG. 4, gradient displacements (i.e., the displacements of the piston-style movement) for high-frequency, mid-frequency, and low-frequency of audible range are not the same; the piston displacement of the high-pitched tone is small, the piston displacement of the mid-range tone is larger than that of the high-pitched tone, whereas the piston displacement of the low-pitched tone is the largest. Based on this theory, the single sound membrane 2 of present invention should be able to satisfy the piston-style displacements of different tones at a same time.

Figures 5, 5A:
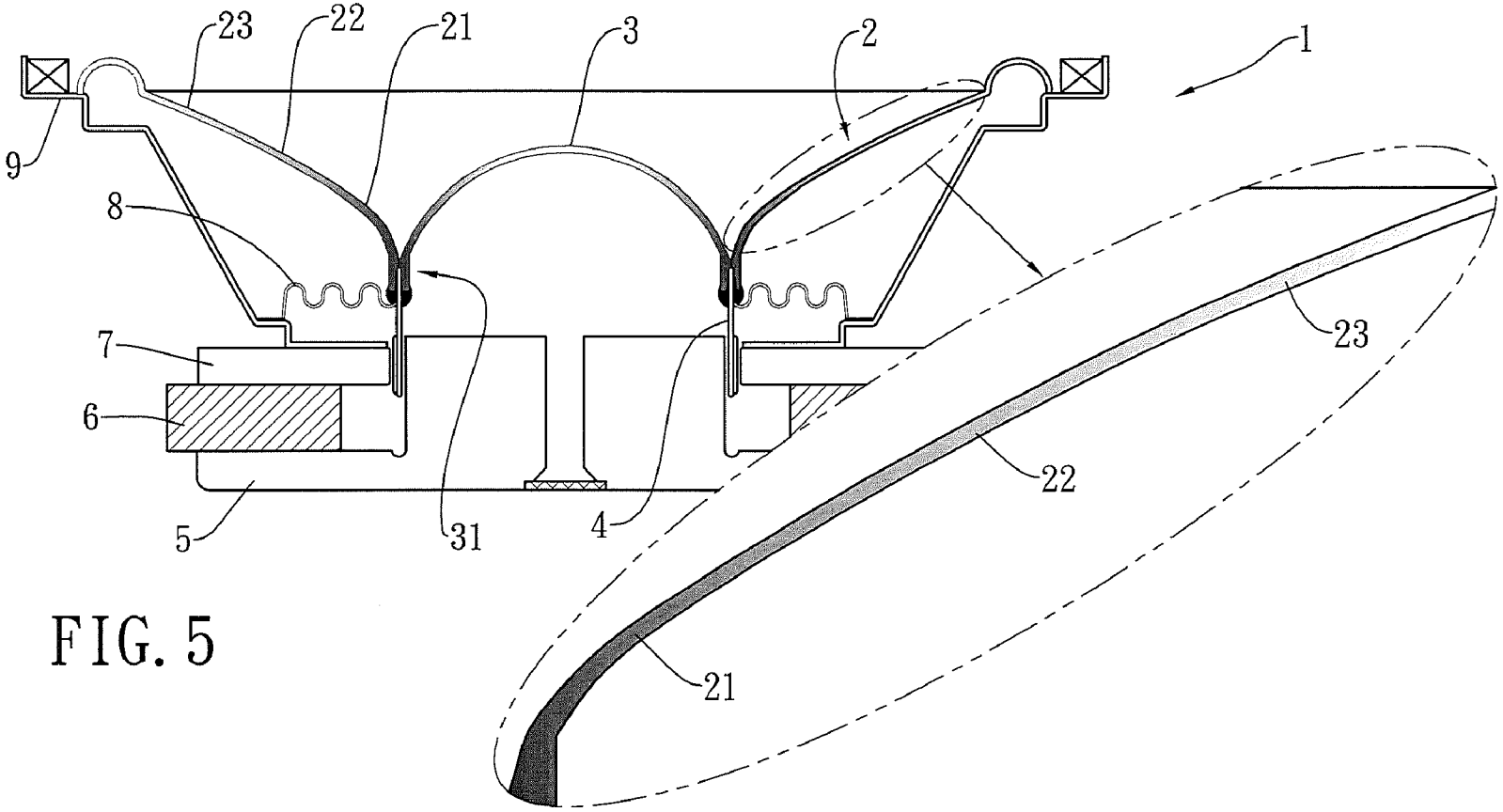
FIG. 5 shows a local exploded view of a sound membrane of a speaker of the present invention.
FIG. 5A shows a partially enlarged view of a sound membrane of a speaker of the present invention.

Referring to FIG. 5, from an inner rim surrounding the central dust cover 3 gradually towards an outer rim of the sound membrane 2, structural intensity, density, and beating degree (or Schopper-Riegler (SR)) are properly changed, wherein the structural intensity gradually decreases from high to low, with a gradient and radiant variation, such that the sound membrane 2 can be roughly divided into a high-intensity fine-fiber membrane 21, a mid-intensity mid-fiber membrane 22, and a low-intensity coarse-fiber membrane 23.

The high-intensity fine-fiber membrane 21 is responsible for sounding the high-pitched tones, and is primarily made by high intensity material of beating structure. The beating degree is essentially SR28°, but can be adjusted according to actual material structure to fit with the high-intensity membrane structure. The membrane material can be chosen from hemp, flax, high-intensity chemical fiber, nano-grade chemical fiber, or other suitable material.

The mid-intensity mid-fiber membrane 22 is responsible for sounding the mid-range tones, and is primarily made by mid-intensity material of beating structure. The beating degree is essentially SR23°, but can be adjusted according to actual material structure to fit with the mid-intensity membrane structure. The membrane material can be chosen from sulfite pulp, kraft pulp, or other suitable material.

The low-intensity coarse-fiber membrane 23 is responsible for sounding the low-pitched tones, and is primarily made by low-intensity material of beating structure. The beating degree is essentially SR18°, but can be adjusted according to actual material structure to fit with the low-intensity membrane structure. The membrane material can be chosen from wool, kapok, bullet-proof chemical fiber, or other suitable material.

Depending on the property of each gamut, other combination of suitable materials according to a proper proportion can be also chosen as the material of aforementioned sound membranes of present invention, including animal fiber, plant fiber, chemical fiber, mineral, glass chemical fiber, carbon fiber, chemical auxiliary material, or other suitable material.

Accordingly, in a cross-section of the single sound membrane 2, the material compositions, beating degrees, structural intensities, and densities at each position are all different; especially that the structural intensities are smoothly changed in a gradient from inside to outside. The beating degree gradually decreases from SR28° for the high-intensity fine-fiber membrane 21 to SR23° for the mid-intensity mid-fiber membrane 22, and then slowly decreases to SR18° for the low-intensity coarse-fiber membrane 23; however, for the actual material structure, the beating degrees can be adjusted to fit with the membranes of all kinds of intensities. In short, from the high-intensity fine-fiber membrane 21 to the low-intensity coarse-fiber membrane 23, the beating degree decreases slowly from about SR28° to SR18° in the gradient. Therefore, in the single sound membrane 2, as the structural intensities of each cross-sectional position are different, there will be different piston-style movements. Accordingly, requirement of outputting the sounds of all kinds of frequencies of the high-pitched, mid-range, and low-pitched tones, in the physical property of sounding, can be satisfied, thereby sufficiently manifesting the perfect quality of full gamut covering the high-pitched, mid-range, and low-pitched tones in the single sound membrane 2.

By using the aforementioned sound membrane structure, the effects of the present invention include at least:

1. In addition to reaching the best tone quality, the single-body speaker can improve efficiency, decrease requirement for a magnetic field of the magnet, and decrease energy consumption of the magnetic field, thereby saving manufacturing cost.
2. By a design of the gradient, radiant, and smooth quality of the tone, design cost of the crossover can be reduced.

3. Under a condition that the conversion efficiency of electrical energy to kinetic energy can be improved, push force of an amplifier and a modified design related to the tone quality can be simplified, which decreases a loss of output efficiency, and increases practicability and functionality of the single-body speaker.

Comparing to the existing technique, the aforementioned three concrete effects can at least decrease about 15~20% of the cost, thereby achieving an object of energy saving.

Figure 1:
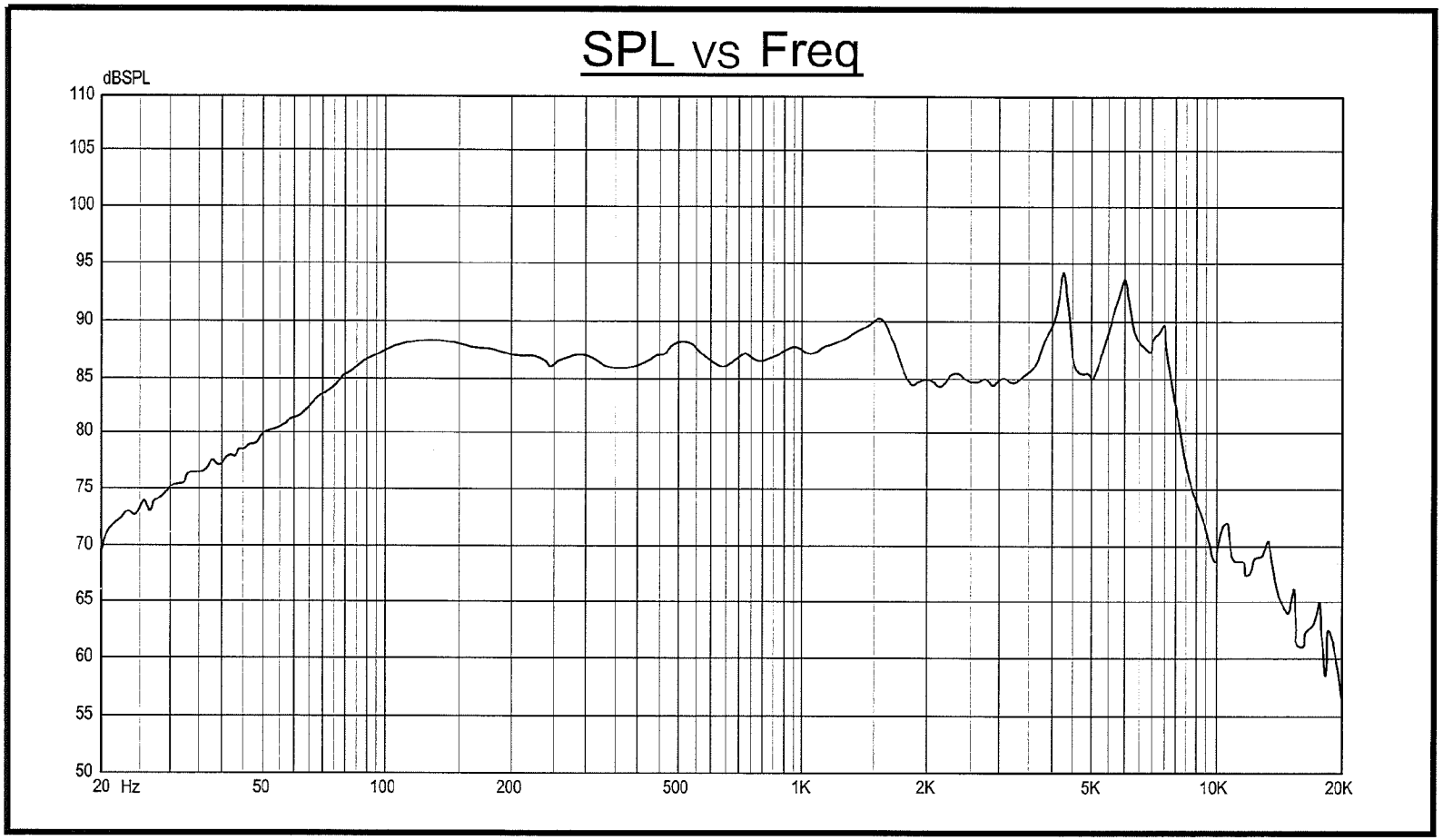
FIG. 1 (Prior Art)
FIG. 1 shows a schematic frequency response diagram of a conventional sound membrane of a speaker.
Figure 6:
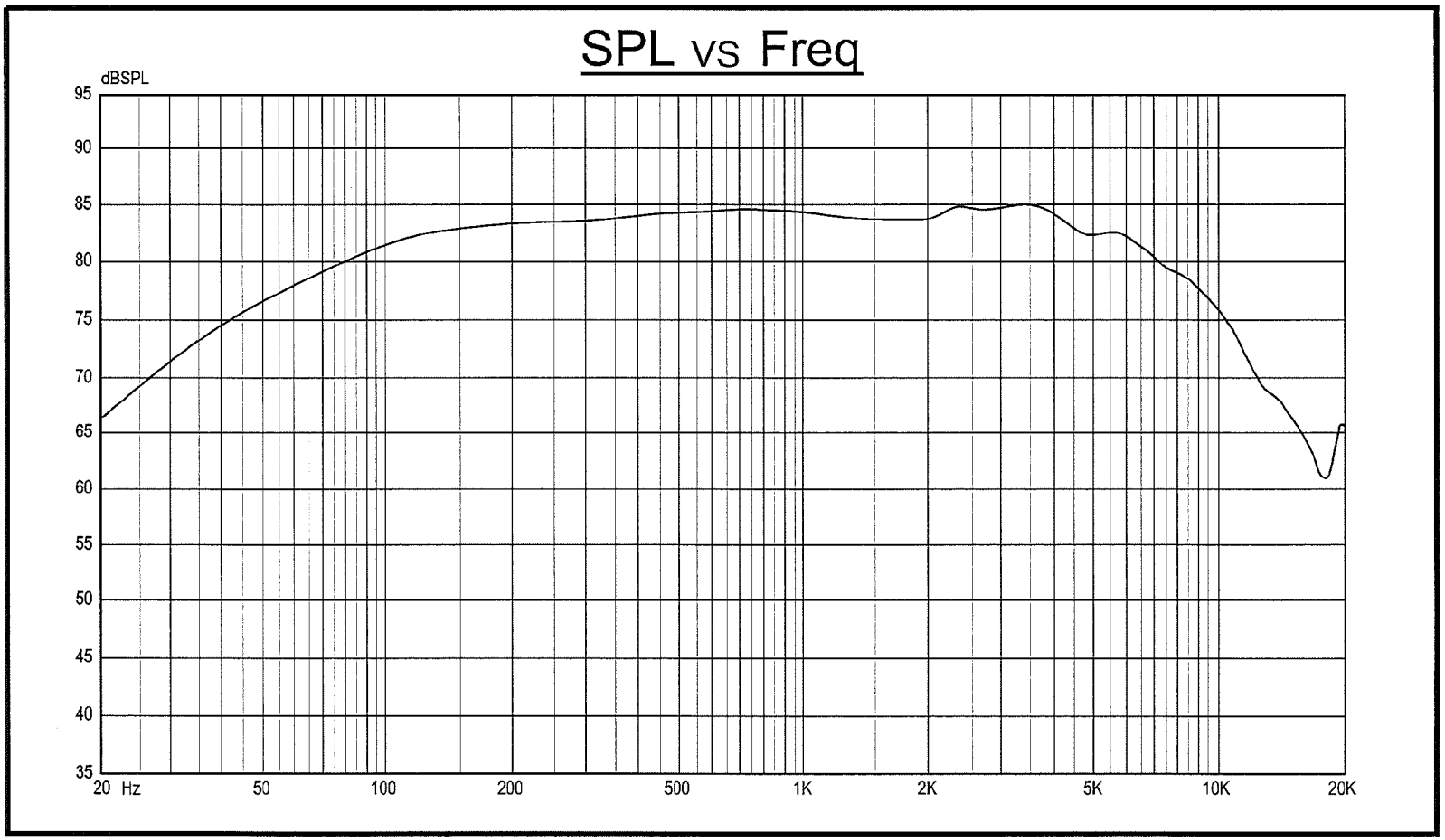
FIG. 6 shows a frequency response diagram of a sound membrane of the present invention.

By an implementation of the present invention, the following advantages are obtained:

1. The tone-quality distortion part can be corrected to achieve a flat and gradient response effect. As shown in FIG. 1, due to reverse resonance, the wave-shape distortion of the frequency response of the conventional sound membrane structure is large. On the contrary, as shown in FIG. 6, the frequency response curve of present invention is flat and in the gradient, has a small distortion in slope, and is provided with high frequency response efficiency; therefore, the tone quality is indeed largely improved as compared to the conventional structure. In addition, its bandwidth is wider, which is wider than that of the conventional structure by about 20%. Furthermore, in the present invention, the structural intensity at a sound membrane position corresponding to the distorted wave-shape can be properly adjusted, to achieve an object of a smooth tone quality without distortion.
2. The requirement of audio equipment can be satisfied, so as to achieve the best audio effect. The smoothness of the characteristic curve can achieve ±2 dB, and the bandwidth can fit with the accurate requirement of full gamut. By the present invention, the benefits of audio equipment design include:
   I. In terms of the single-body speaker, because the present invention is provided with the high efficiency, the intensity of magnetic field required can be reduced, and a smaller magnet can be used without employing a large magnet of high cost.
   II. In terms of sound box design, the complex sound box crossover design is not needed, which can reduce the manufacturing cost of hardware material.
   III. In terms of an amplifier, as the efficiency of present invention is improved, the amplifier can use a lower power design, which can also reduce the manufacturing cost of a circuit and energy consumption.

Figure 7:
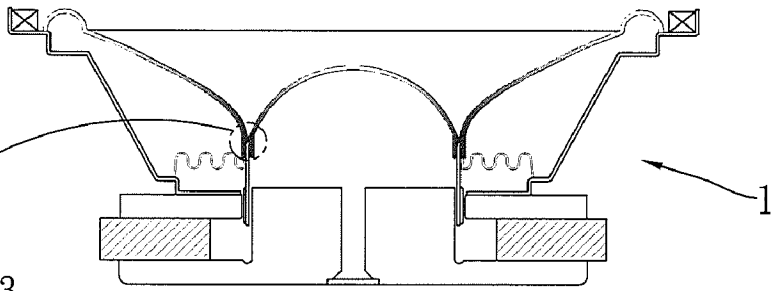
FIG. 7 shows a schematic view of an assembly structure combining a sound membrane and a voice coil of the present invention.
Figure 7A:
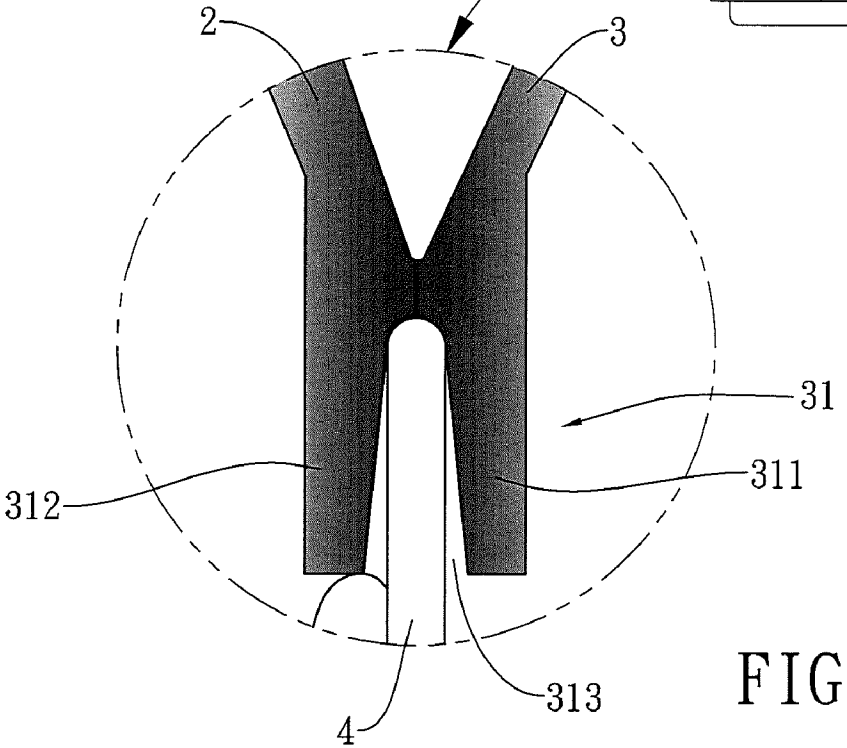
FIG. 7A shows a partially enlarged view of an assembly structure combining a sound membrane and a voice coil of the present invention.
Figure 8:
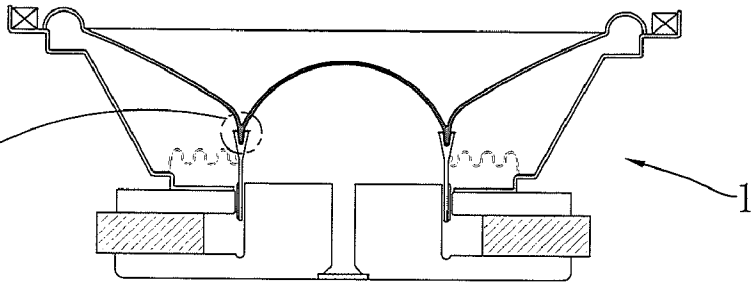
FIG. 8 shows a schematic view of another assembly structure combining a sound membrane and a voice coil of the present invention.
Figure 8A:
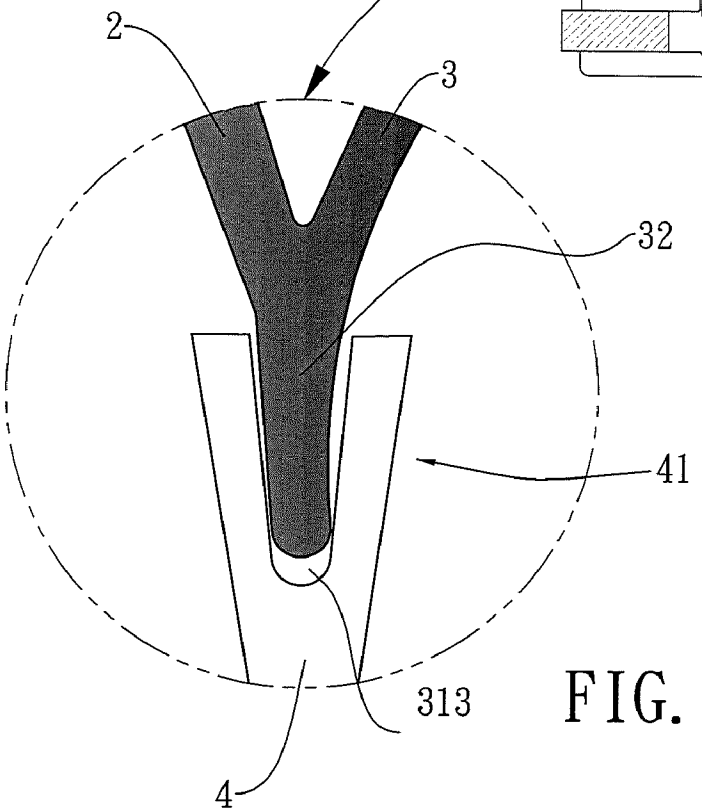
FIG. 8A shows a partially enlarged view of another assembly structure combining a sound membrane and a voice coil of the present invention.

An assembly structure of the sound membrane 2 and the voice coil 4 in the speaker 1 of present invention is further described. Referring to FIG. 7, an inner rim of the sound membrane 2 is integrally connected with the dust cover 3, and an assembly structure 31 is specifically located at the connection place. The assembly structure 31 includes an inner ring 311 and an outer ring 312, and bottoms of the inner ring 311 and the outer ring 312 are formed with an assembly slot 313. The cross section of assembly structure 31 can be in a shape of or ∩, and the assembly slot 313 is used to emplace and assemble with a top part of the voice coil 4. As the piston-style movement of sound membrane 2 is completely dependent on a push of the voice coil 4, the ideal assembly structure of voice coil 4 and sound membrane 2 is very important. In the present invention, the connection place of the voice coil 4 is located in the assembly slot 313 at the inner bottom of the sound membrane 2, which can be provided with a good pushing and connection effect. Compared to the conventional structure that the voice coil is connected at a side of the sound membrane, the present invention is provided with a better assembly effect. The aforementioned structure can be also implemented at an embodiment as shown in FIG. 8, wherein an assembly structure 41 is located at a top part of the voice coil 4, the cross section of an assembly slot 413 of that assembly structure 41 can be in a shape of V or U, and the assembly slot 413 can be used to emplace and assemble with an extension structure 32 at a bottom end of the sound membrane 2.

Figure 9:
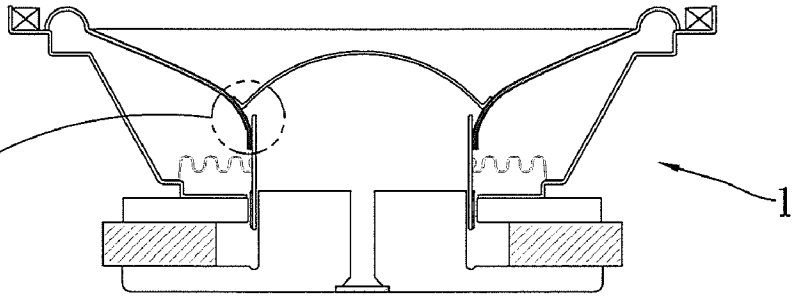
FIG. 9 shows a cross-sectional view of another speaker of the present invention.
Figure 9A:
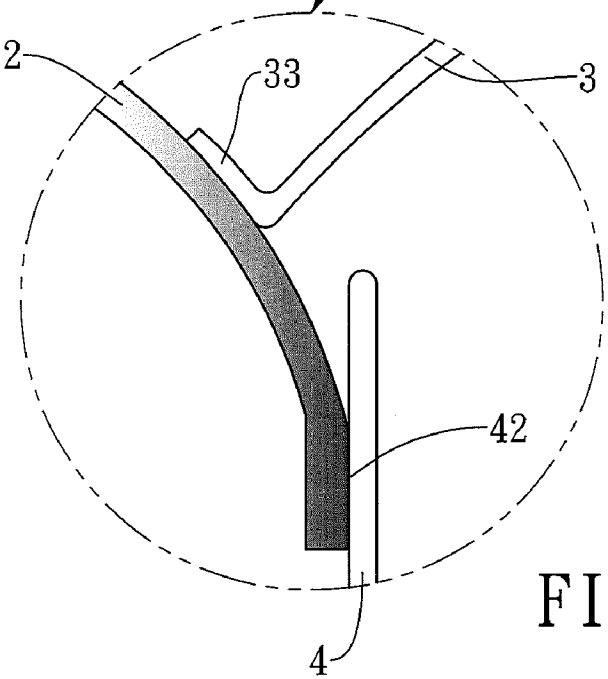
FIG. 9A shows a partially enlarged view of another speaker of the present invention.

Referring to FIG. 9, it shows a schematic view of another embodiment of the speaker 1 of present invention, wherein the major difference lies in the connection place and method of sound membrane 2, dust cover 3, and voice coil 4. The sound membrane 2 and the dust cover 3 are assembled with an assembly part 33, whereas the sound membrane 2 and the voice coil 4 are assembled with an assembly part 42.

Accordingly, in the present invention, the full-gamut gracious quality of the high-pitched, mid-range, and low-pitched tones can be perfectly manifested in the single sound membrane. Furthermore, the cost of peripheral equipment can be reduced, and the response efficiency can be improved. Therefore, as compared to the conventional technique, the present invention is apparently provided with the break-through development, and can indeed largely increase the practicability and functionality of the sound membrane of the speaker.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A sound device, comprising:

a full-gamut single-body sound membrane;

a voice coil;

a dust cover; and an assembly structure, materials of different kinds of beating degrees being applied at different positions of the sound membrane, wherein a structural intensity of materials is changed radiantly, radially and gradually, from an innermost rim of the sound membrane toward an outermost rim of the sound membrane, such that the structural intensity gradually decreases from the innermost rim toward the outermost rim, to satisfy requirements of sounding for the full-gamut of audible frequency, wherein the sound membrane, integrally manufactured as a single body, includes at least a high-intensity fine-fiber membrane, a mid-intensity mid-fiber membrane, and a low-intensity coarse-fiber membrane, which are formed by changing the structural intensity of the material radiantly, radially and gradually, further wherein the high-intensity fine-fiber membrane is made by high-intensity material of beating structure essentially based on a beating degree of Schopper-Riegler (SR)28° with a margin of SR5°, with the beating degree being adjusted to conform with the structure of the high-intensity fine-fiber membrane, and further wherein the high-intensity material is chosen from hemp, flax, high-intensity chemical fiber or nano-grade chemical fiber.

2. The sound device according to claim 1, wherein a combination of the materials of the mid-intensity mid-fiber membrane and low-intensity coarse-fiber membrane includes animal fiber, plant fiber, chemical fiber, mineral, glass chemical fiber or carbon fiber.

3. The sound device according to claim 1, wherein the sounding is performed in an adjustable range of audible frequency, including the full gamut of audible frequency.

4. The sound device according to claim 1, wherein the inner rim of the sound membrane is integrally connected with the dust cover, and a connection place is provided with the assembly structure which includes an inner ring and an outer ring, with bottoms of the inner ring and the outer ring being formed with an assembly slot for emplacing and assembling a top part of the voice coil.

5. The sound device according to claim 4, wherein a cross section of the assembly slot is in a shape of reverse V or reverse U.

6. The sound device according to claim 1, wherein the assembly structure is located at a top part of the voice coil and an assembly slot of assembly structure is assembled with an extension structure at a bottom end of the sound membrane.

7. The sound device according to claim 6, wherein the cross section of assembly slot is in a shape of V or U.

8. The sound device according to claim 1, wherein the sound membrane and the dust cover are assembled with an upper assembly part, and the sound membrane and the voice coil are assembled with a lower assembly part.

9. A sound device, comprising:

a full-gamut single-body sound membrane;

a voice coil;

a dust cover; and an assembly structure, materials of different kinds of beating degrees being applied at different positions of the sound membrane, wherein a structural intensity of the materials is changed radiantly, radially and gradually, from an innermost rim of the sound membrane toward an outermost rim of the sound membrane, such that the structural intensity gradually decreases from the innermost rim toward the outermost rim, to satisfy requirements of sounding for the full-gamut of audible frequency, further wherein the sound membrane, integrally manufactured as a single body, includes at least a high-intensity fine-fiber membrane, a mid-intensity mid-fiber membrane, and a low-intensity coarse-fiber membrane, which are formed by changing the structural intensity of the material radiantly, radially and gradually, further wherein the mid-intensity mid-fiber membrane is made by mid-intensity material of beating structure essentially based on a beating degree of Schopper-Riegler (SR 23°) with a margin of SR5°, with the beating degree being adjusted to conform with the structure of the mid-intensity mid-fiber membrane, and the mid-intensity material is chosen from sulfite pulp or kraft pulp.

10. A sound device, comprising:

a full-gamut single-body sound membrane;

a voice coil;

a dust cover; and an assembly structure, materials of different kinds of beating degrees being applied at different positions of the sound membrane, wherein a structural intensity of the materials is changed radiantly, radially and gradually, from an innermost rim of the sound membrane toward an outermost rim of the sound membrane, such that the structural intensity gradually decreases from the innermost rim toward the outermost rim, to satisfy requirements of sounding for the full-gamut of audible frequency, further wherein the sound membrane, integrally manufactured as a single body, includes at least a high-intensity fine-fiber membrane, a mid-intensity mid-fiber membrane, and a low-intensity coarse-fiber membrane, which are formed by changing the structural intensity of the material radiantly, radially and gradually, wherein the low-intensity coarse-fiber membrane is made by low-intensity material of beating structure essentially based on a beating degree of Schopper-Riegler (SR)18° with a margin of SR5°, with the beating degree being adjusted to conform with the structure of the low-intensity coarse-fiber membrane, and the low-intensity material is chosen from wool, kapok or bullet-proof chemical fiber.

* * * * *